United States Patent [19]

Jakob et al.

[11] 4,139,318

[45] Feb. 13, 1979

[54] METHOD AND APPARATUS FOR PLANING A PAVED ROADWAY

[75] Inventors: Herbert E. Jakob, Oklahoma City; Richard A. Silbernagel, Del City, both of Okla.

[73] Assignee: CMI Corporation, Oklahoma City, Okla.

[21] Appl. No.: 672,326

[22] Filed: Mar. 31, 1976

[51] Int. Cl.[2] ..... E01C 23/08

[52] U.S. Cl. ..... 404/90; 404/84; 299/39; 37/43 E; 198/300; 172/540; 172/118; 172/119

[58] Field of Search ..... 404/90, 83, 84, 75, 404/96; 198/213; 299/39, 91, 87, 79; 172/540, 118; 37/13, 43 E, 43 C

[56] References Cited

U.S. PATENT DOCUMENTS

| | | | |
|---|---|---|---|
| 1,255,275 | 2/1918 | Barnett | 36/43 E X |
| 1,269,098 | 6/1918 | Latta | 37/43 E X |
| 1,938,755 | 12/1933 | Swearingen | 404/91 |
| 3,398,989 | 8/1968 | Christensen | 299/39 |
| 3,407,005 | 10/1968 | Simms | 299/39 |
| 3,414,327 | 12/1968 | Austin | 299/39 X |
| 3,598,027 | 8/1971 | Swisher | 404/90 |
| 3,606,468 | 9/1971 | Walker | 299/39 |
| 3,767,264 | 10/1973 | Eckey | 299/39 |
| 3,779,661 | 12/1973 | Godberson | 404/98 X |
| 3,829,161 | 8/1974 | Wirtgen | 299/39 |
| 3,874,735 | 4/1975 | Delli-Gatti | 299/87 X |
| 3,893,780 | 7/1975 | Gutman | 404/91 |

*Primary Examiner*—Nile C. Byers, Jr.
*Attorney, Agent, or Firm*—Dunlap, Codding & McCarthy

[57] ABSTRACT

A method and apparatus for planing a paved roadway wherein a main frame is drivingly supported by track assemblies and a planer assembly is disposed in cutting engagement with a top portion of the paved roadway to produce a new roadway surface. An elevation positioning assembly is provided for raising and lowering the main frame in response to an external control reference such as a string line, and a cross slope positioning assembly is provided for raising and lowering one side of the main frame relative to the other side thereof for maintaining a selected cross slope. The planer assembly comprises a planing cutter that is partially surrounded by a hood that forms a material directing compartment, and spray nozzles produce a vapor mist within the compartment. A floating moldboard is yieldingly forced into contact with the roadway to the rear of the planer assembly and cooperates with a reclaimer assembly to receive and transport the removed pavement material to a selected depository. In one embodiment, a road sweeper is pulled behind the main frame to remove any loose material that may remain on the new roadway surface.

12 Claims, 11 Drawing Figures

METHOD AND APPARATUS FOR PLANING A PAVED ROADWAY

BACKGROUND OF THE INVENTION

1. Field of the Invention

The present invention relates generally to field construction apparatus, and more particularly but not by way of limitation, to a method and planer type road construction apparatus that affords precision planing of existing paved roadways.

2. Description of the Prior Art

The planing of roadways or the like involves the use of heavy duty cutting devices that remove a selected top portion of a concrete or bituminous surface. Planing provides an alternative to the usual practice of continued buildup of bituminous layers over a roadway in a resurfacing program of maintenance and repair. As is well known in the art, when a roadway has received a number of resurfacing bituminous layers, there comes a time that the roadway can no longer be simply resurfaced, and the accumulation of layers of bituminous material must be torn out and the roadway is in essence constructed anew. This buildup of bituminous layers is prevented if the to surface of the old roadway is partially removed so that the freshly laid bituminous surface is applied over a recessed surface.

Prior art planers used in the road construction industry have generally consisted of a planing cutter suspended from the undercarriage of grading equipment or the like. Such prior art planers have found limited usage in a road building program for the reason that the planing process performed thereby was generally inaccurate and relatively slow. In an attempt to increase the rate of planing bituminous surfaces, several prior art devices have used heaters to heat the bituminous roadway just in front of the planer's travel to reduce the force required of the planing cutter. The heaters used in the technique known as hot planing usually were fueled by a petroleum product, and were consequently expensive to operate as well as being objectionable due to the production of hydrocarbon vapors and the products of combustion. Also, the roadway serves as a heat sink during hot planing, and it was quickly discovered that an attempt to heat a frozen or very cold bituminous roadway was largely an exercise in futility, leading to the necessity of scheduling hot planing during the warmer seasons of the year. Cold planing, although requiring more cutting power, did not have seasonal limitations.

Furthermore, material removed by the cutting action of prior art planers created considerable problems in cleaning the planed surface, as a large amount of debris was generated and left in the wake of the planar. In cold planing, the planing process literally created a cloud of dust and cuttings, and the whole process was generally very dirty, bothersome and time-consuming.

Perhaps all of the above conditions would have been tolerable and planing would have achieved wider acceptance if accurate surface removal could have been effected, but the results achieved in planing a particular roadway in the past depended very largely upon the skill of the operator. It was also apparent that the greater the depth of cut taken by a pass of a planing cutter, the greater the problem of obtaining a uniform and accurately cut substrate for the next layer of bituminous material. Therefore, it was often necessary to take multiple cutting passes, or to restrict the use of the planing process to those applications which required only shallow cuts.

It is clear from the above that the practice of planing, as applied to the road construction art, has had very limited application. There has not been a way to achieve precision planing for the removal of a selected portion of a roadway to provide a new roadway surface having a predetermined grade and cross slope as is presented by the present invention.

SUMMARY OF THE INVENTION

The present invention provides a method and apparatus for removing the top surface of an existing paved roadway and producing a planed surface having a predetermined grade and cross slope. A planing cutter is passed over the existing roadway surface to remove a selected portion thereof, the planing cutter being controllably supported so that the newly created surface has a predetermined grade and cross slope.

Accordingly, it is an object of the present invention to provide a method and apparatus for removing the top surface of an existing paved roadway to produce a new surface having a predetermined grade and cross slope.

Another object of the present invention is to provide a method and apparatus to achieve the above stated object while at the same time clearing the removed material from the new surface.

Another object of the present invention is to provide a method and apparatus to achieve the above stated objects while minimizing dust and other particulate matter in the surrounding air.

Another object of the present invention is to provide a method and apparatus to achieve the above stated objects in a manner that permits year round operation, independent to most weather considerations.

Another object of the present invention is to provide a method and apparatus to achieve the above stated objects in an efficient and economical manner.

Other objects and advantages of the invention will be evident from the following detailed description when read in conjunction with the accompanying drawings which illustrate various embodiments of the invention.

DESCRIPTION OF THE PREFERRED EMBODIMENT

Figure 1:
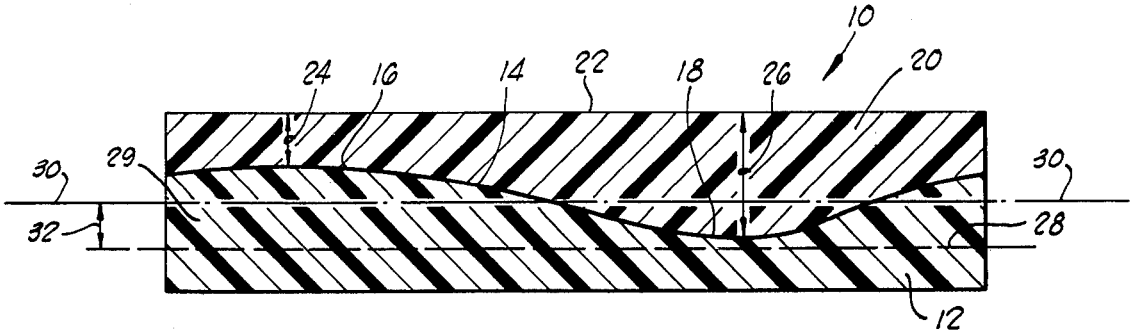
FIG. 1 is a diagrammatical representation of a cross section of a typical paved roadway tht has been resurfaced.

In the discussion that is to follow, it will be well to begin with a somewhat more detailed description of the different approach to road maintenance that is herein presented. Referring to FIG. 1, shown therein is a diagrammatical representation of a cross section of a typical paved roadway 10 that has been resurfaced.

The paved roadway 10 has an original base layer of bituminous asphalt 12 thus developed through traffic usage, a very rough top surface 14 that has highs and lows therein, a peak 16 and a valley 18 being typical. Of course, a typical top surface of a well worn paved roadway can have a variety of swells and pockets, and in general, surface damage of many varieties. Therefore, it will be understood that the present invention is not limited to the conditions depicted by FIG. 1; rather, the undulating top surface 14 as shown in FIG. 1 has been drawn in a manner to demonstrate the present invention.

A typical repair of the paved roadway 10 depicted in FIG. 1 would be to overlay the base layer 12 with a bituminous layer 20, a technique that is well known and practiced widely throughout the road construction industry. The layer 20 (also referred to herein as the old technique layer) would normally be compacted with a bituminous paving roller to obtain a smooth upper surface 22. Of course, it will be appreciated that the layer 20 must have sufficient thickness 24 over the peak 16 to give a strong resurfacing job, and further, that the layer 20 must have a thickness at the valley 18 to give the smooth upper surface 22.

It is well known that the wear of a bituminous layer will be greatly influenced by the uniformity of its substrate. That is, a bituminous layer that is laid over a uniformly even substrate surface will hold up very well in traffic usage. One of the reasons for this is that the layer is capable of receiving uniform compaction in the final rolling operation commonly practiced in the road-building art. On the other hand, when a bituminous layer is laid over a surface like the one depicted by the top surface 14 in FIG. 1, experience has shown that the amount of compaction achieved is not uniform, and that less compaction will occur over the valley 18 than over the peak 16. As the new layer 20 is subjected to traffic, it will be further compacted by the traffic and the smooth upper surface 20 will be shifted and redistributed. As wear forces continue, the roadway once again will come into a state of disrepair.

The present invention contemplates the use of precision planing wherein a portion of the base layer 12 will be removed prior to the resurfacing of a paving roadway. Referring once again to FIG. 1, the present invention teaches a method and apparatus for selectively removing material from the roadway down to a new roadway surface 28 as indicated by the dashed line. It should be noted that the new roadway surface 28 is shown in a location just below the valley 18, which is a plane of recession selected so as to have some material removed at all points of the old top surface 14. While this is not essential, it is desirable as a more uniformly even new roadway surface is thereby obtained.

Once the new roadway surface 28 has been created by planing the old top surface 14, a uniform layer 29 of bituminous material can be laid to a level indicated by a broken line 30 having a thickness 32 that may be the same as, or less than, the thickness 24 that was needed over the peak 16 by the old paving technique. It is obvious that far less bituminous material will be necessary for the layer 29 (also referred to as the new technique layer) as compared to the amount of material for the old technique layer 20 for the reason that it is no longer necessary to fill the valley 18 in order to cover the peak 6. In fact, the new technique layer 29 can be made significantly thinner than the minimum thickness required of the old technique layer 20. The reason for this is that the thickness 24 of the old technique layer 20 must be adequate to withstand lateral tearing forces incurred with the shifting of the material in the layer 20 during traffic wearing as mentioned above. Since lateral movement is less of a consideration in the new technique layer 29 laid over the uniform new roadway surface 28, the thickness 32 can be reduced to between approximately $\frac{1}{3}$ to approximately $\frac{1}{2}$ of previously used resurfacing layers, with the actual thickness used being dependent upon the traffic requirements of a particular location.

An added benefit of a precision planing operation prior to resurfacing is the lack of buildup of the paved roadway that occurs in the old method of adding successive resurfacing layers. This buildup has become so great in many areas that the pavement has overrun the original curbing, gutters and manhold skirts, leading to the necessity in many such cases of having to extend these items to reach the increased pavement elevation. In the practice of the present invention, this buildup is avoided as the surface of the new layer can be maintained with a grade and cross slope approximately equal to that of the original pavement, and this can be achieved for each subsequent resurfacing layer laid on a paved roadway throughout the life of the roadway.

Further, the resultant planed surface 28 that is created by the method and apparatus taught herein is a very clear surface, being free of oil and other road films. The planed surface 28 is a generally smooth, yet textured, surface which provides a very good bonding surface for overlay with concrete, latex concrete or asphalt. In fact, there are many applications in which the planed surface 28 can be used without an overlay, as for example when removing the top portion of a roadway that has received several bituminous layers. Such roads can possibly be planed several times in a repair program designed to lessen the overall thickness of paved material while using the new roadway surface 28 as an intermediate roadway.

While a bituminous roadway has been shown in FIG. 1 to illustrate the present invention, it is not limited to the planing of bituminous material. The invention teaches precision planing, and it relates as well to other types of pavement, such as concrete or the like, as will become clear in the following discussion. When bituminous material is removed by the invention, the removed pavement material can be recycled by heating the removed pavement material and adding it in controlled measure to new bituminous pavement material. Removed concrete, or other such pavement materials, may also find recycle use as aggregate fill material.

Figure 2:
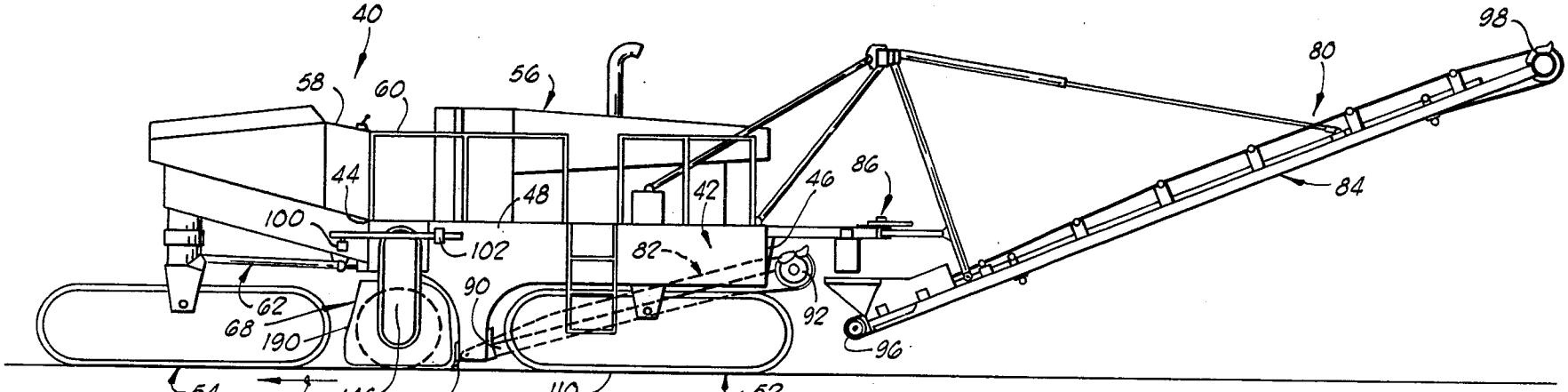
FIG. 2 is a side elevational view of a planar type road construction apparatus constructed in accordance with the present invention.
Figure 3:
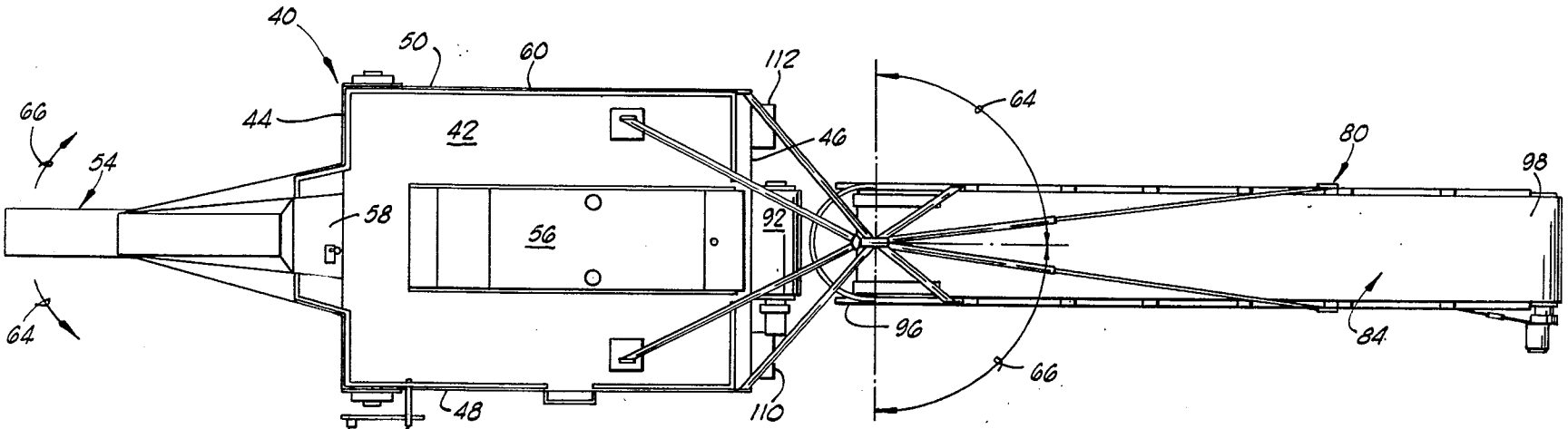
FIG. 3 is a top plan view of the planar apparatus shown in FIG. 2.

Turning now to the description of the preferred embodiment for practicing the present invention, attention is directed to FIGS. 2 and 3 wherein is shown a planer type road construction apparatus 40 constructed in accordance with the present invention. The planer apparatus 40 includes a main frame 42 having a forward end 44, a rearward end 46, a left side 48 and a right side 50. The main frame 42 is supported via a rear drive assembly 52 and a front track assembly 54, the rear drive assembly 52 being drivingly connected to a power drive unit 56 for drivingly moving the main frame 42 during the operation of the planer type road construction apparatus 40. The power drive unit 56 may be of a conventional design such as, for example, a diesel powered engine, and the construction and operation of such a power unit, and the various interconnecting components and operation thereof to drivingly connect the power drive unit 56 to the endless track members, are well known in the art and a detailed description thereof will not be required herein. The major portion of the various manually operated and control actuating elements, which are utilized by an operator to control and operate the planer type road construction apparatus 40, is, in a preferred form, supported in a control console 58. The control console 58 is supported on the main frame 42, generally near the forward end 44 thereof, and a guard-rail type of structure 60 is connected to the main frame 42, as shown in FIGS. 2 and 3.

A steering assembly 62 is connected to the main frame 42 and to a portion of the front track assembly 54 for steering the planer type road construction apparatus 40. More particularly, the steering assembly 62 is constructed to automatically steer the front track assembly 54 in a steering direction 64 and a steering direction 66, as shown in FIG. 3, to steeringly maintain the alignment of the planer type road construction apparatus 40 relative to a control reference, commonly a "string-line", in one aspect of the operation of the planer type road construction apparatus 40.

A planer assembly 68 is supported on the main frame 42, generally near the forward end 44 thereof, and a floating moldboard 70 is also connected to the main frame 42, generally near the planer assembly 68.

A reclaimer assembly 80, which generally includes a base conveyor 82 and an elevated conveyor 84, is supported on the main frame 42 for receiving the removed pavement material removed by the planer assembly 68 and for depositing same in a predetermined, controlled, remote location or selected depository. The reclaimer assembly 80 is of the type taught in U.S. Pat. No. 3,946,506, entitled "Conveyor and Control Apparatus for Road Construction Apparatus or the Like", assigned to the assignee of the present invention. Therefore, a detailed description of the various components, and the cooperation of those components, of the reclaimer assembly 80 will not be required herein. Rather, it will be sufficient to state that the base conveyor 82 is supported generally between the left side 48 and the right side 50, and extends angularly downwardly from near the rearward end 46 of the main frame 42 to the floating moldboard 70.

As will become clear below, the base conveyor 82 receives removed pavement material at a material receiving end 90 and moves the material toward a material delivery end 92 which is disposed near the rearward end 46 of the planer type road construction apparatus 40. The elevated conveyor 84 has a material receiving end 96 disposed in material receiving relationship to the material delivery end 92 of the base conveyor 82, and the material received therefrom is moved via an endless belt to a material delivery end 98 for depositing the material in a selected position behind the planer type road construction apparatus 40. The general construction details of the base conveyor 82 and the elevated conveyor 84 are provided in U.S. Pat. No. 3,946,506, mentioned above, and the further details are not necessary herein, with the exception that the material receiving end 90 of the base conveyor 82 is supported by the floating moldboard 70 as described below.

The front track assembly 54 and the rear drive assembly 52 are of the type described in U.S. Pat. No. 3,802,525, entitled "Trimmer Type Road Construction Apparatus or the Like", and assigned to the assignee of the present invention. Therefore, it will not be necessary to fully describe the construction details of the front track assembly 54 in the present disclosure. The rear drive assembly 52 comprises a left track assembly 110 connected to the left side 48 of the main frame 42 and a right track assembly 112 connected to the right side 50 of the main frame 42.

The planer type road construction apparatus 40 as illustrated herein comprises a planer assembly 68 mounted on a frame that is supported and driven by a three track drive assembly. This illustration is exemplary only, as the present invention is not limited to the drive assemblies 52, 54 described herein for purposes of this disclosure, an important consideration being that when the planer assembly 68 is rigidly fixed to the frame of the propelling machine, which is the preferred embodiment, the frame must be supported in such a manner that the frame may be precisely controlled as to grade and cross slope while the planer assembly 68 is operating.

In the preferred form of the present invention, the planer type road construction apparatus 40 is automatically actuated in an actuated position thereof in response to an output signal of a track steering sensor that senses the location of an external reference line such as a string-line. Also, the elevation of the main frame 42 relative to the front track assembly 54 and the rear drive assembly 52 is automatically actuated and controlled in an actuated position thereof in response to an elevation sensor that senses the location of an external reference line such as a string-line. A track steering sensor 100 and an elevation sensor 102 are each supportedly connected to the left side 48 of the main frame 42 generally near the forward end 44 thereof. The construction of such sensors and the utilization of sensors such as the track steering sensor 100 and the elevation sensor 102 to provide an output signal responsive to a control reference are well known in the art, such sensors for example being described in U.S. Pat. No. 3,423,859, entitled "Road Construction Methods and Apparatus", assigned to the assignee of the present invention. Furthermore, the application of such sensors and the supporting hydraulic and electrical circuitry to steeringly control the main frame 42 and to raise and lower the main frame 42 relative to the drive assembly (the track assemblies 54, 110 and 112) in an actuated position thereof is described in U.S. Pat. No. 3,802,525, entitled "Trimmer Type Road Construction Apparatus or the Like", assigned to the assignee of the present invention. Therefore, further details of the construction and operation such sensors are not necessary for purposes of the present disclosure.

Further, in the manner of that described in U.S. Pat. No. 3,802,525, the elevation of one side of the main frame 42 is set in a predetermined elevation setting and the elevation of the other side thereof is automatically controlled via an automatic slope sensor and control apparatus to position the main frame 42 in a predetermined grade and slope position during the operation thereof. Automatic control equipment to establish a predetermined grade and slope of the main frame 42 is also taught in U.S. Pat. No. 3,423,859, cited above. Therefore, a detailed description of such equipment and the cooperation of the components necessary to provide such control is not required herein.

Figure 4:
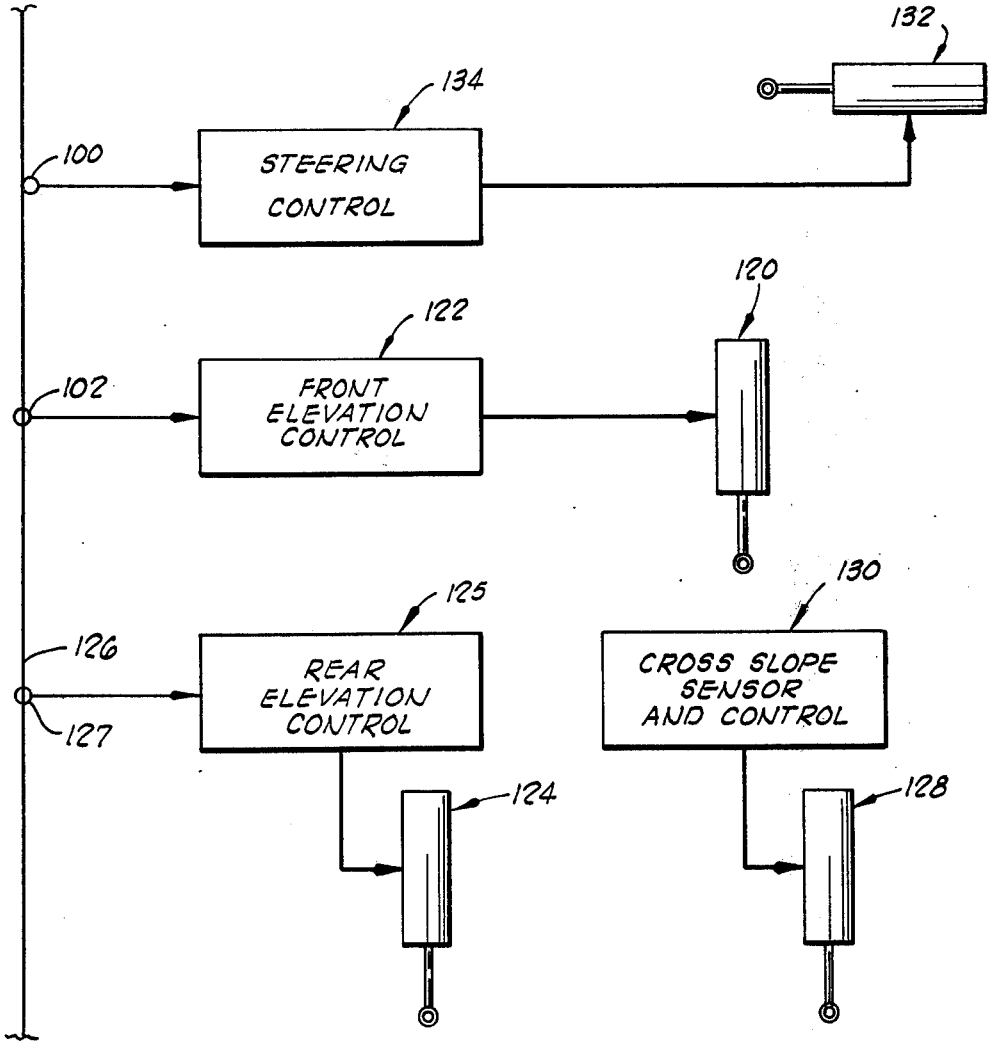
FIG. 4 is a block diagram depiction of the steering, elevation and cross slope control mechanisms of the planar apparatus of FIG. 2.

As stated above, construction details of the control of the steering, elevation and cross slope of the main frame 42 are not required herein as this may be readily obtained from the cited patents. However, it is believed useful to include a discussion of the operation of such equipment by reference to a block diagram as shown in FIG. 4. As shown therein, a double acting front elevation cylinder 120 is shown connected to a front elevation control apparatus 122. Also, a double acting, left rear elevation cylinder 124 is also connected to a rear elevation control apparatus 125. As described in the patents cited above, the front elevation cylinder 120 is connected to the forward end 44 of the main frame 42 and to the front track assembly 54 for the purpose of raising or lowering the forward end 44 when the front elevation cylinder 120 is actuated. In like manner, the left rear elevation cylinder 124 is connected to the left side 48 of the main frame 42 and to the left rear track assembly 110 for the purpose of raising or lowering the left side 48 when the left rear elevation cylinder 124 is actuated. In operation, an external reference line 126 (which may be a string-line or the like) is followed by the elevation sensor 102 and an appropriate control signal is sent thereby to the front elevation control apparatus 122 that in turn sends pressure fluid to extend or retract the cylinder 120 to establish the elevation of the main frame 42 at the forward end 44 at a predetermined elevation.

The left rear elevation cylinder 124 can be extended and established in a setting corresponding to a predetermined grade (known as locked to grade), or the left rear elevation cylinder 124 can be controlled via a rear elevation control apparatus 125. The operation of the rear elevation control apparatus 125 is identical to that which is described above for the front elevation control apparatus 122. That is, an elevation sensor 127 (not shown in FIGS. 2 and 3) follows the external reference line 126 and an appropriate control signal is sent thereby to the rear elevation control apparatus 125 that in turn sends pressure fluid to extend or retract the cylinder 124 to establish the elevation of the left side 48 of the main frame 42 at a predetermined elevation.

The right side 50 of the main frame 42 is controlled by a double acting, right rear elevation cylinder 128 that is connected to the right side 50 of the main frame 42 and to the right track assembly 112 for the purpose of raising or lowering the right side 50 when the right rear elevation cylinder 128 is actuated. A cross slope sensor and control apparatus 130 senses the cross slope of the main frame 42, compares the cross slope of the main frame 42 to a predetermined cross slope value, and actuates the right rear elevation cylinder 128 to maintain the cross slope of the main frame 42 at the predetermined cross slope value.

Also shown in FIG. 4 is a double acting steering cylinder 132 that is connected to the forward end 44 of the main frame 42 and to the front track assembly 54 for the purpose of pivoting the front track assembly 54 relative to the main frame 42. The steering cylinder 132 is actuated by a steering control apparatus 134. The track steering sensor 100 senses the reference line 126 and signals the steering control apparatus 134 that sends pressurized hydraulic fluid to actuate the steering cylinder 132 as required to maintain the desired path of the planer type road construction apparatus 40.

The above comments relative to FIG. 4 are illustrative only, as it will be understood that the planer type road construction apparatus 40 may be equipped for other modes of operation as well. That is, the track steering sensor 100 and the elevation sensors 102 and 127 may be supported at the right side 50 of the main frame 42, and the reference line 126 disposed along the right side of the planer type road construction apparatus 40. The elevation of the main frame 42 would then be achieved by control of the cylinders 120 and 128, while the cross slope would be controlled via the left rear elevation cylinder 124. Also, it is common to equip road construction apparatus such as the planer type road construction apparatus 40 with manual steering equipment and with manual elevation and cross slope actuating equipment that are of known construction, and the details of such equipement are unnecessary herein.

In summation then, the above described steering, elevation and cross slop controls are exemplary only, and it is within the contemplation of the present invention to provide manula or automatic steering controlled from either side of the planer apparatus 40; to provide manual or automatic elevation capability on all suspension points controlled from either side of the planer apparatus 40; and to provide cross slope capability, controlling as necessary, either side of the planer apparatus 40. And although a string reference line 126 is shown, it is contemplated that a conventional ski apparatus can be used to provide a reference line on either side of the planer apparatus 40, with such ski apparatus being supported to one side of the planer apparatus 40 to give an elevation of a roadway lane or the like that exists alongside of the selected travel of the planer apparatus 40. In this way, the planer apparatus 40 can controlled to provide precision planing with reference to the grade of an existing surface.

Figure 5:
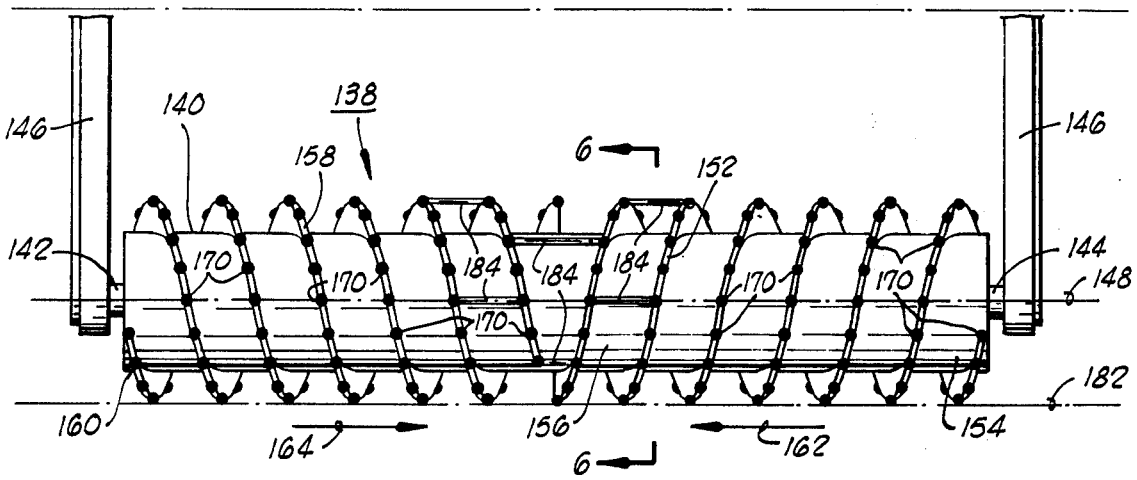
FIG. 5 is a front elevational view in partial detail of the planing cutter of the planer apparatus of FIG. 2.

The planning assembly 68 performs the function of planing the top surface of a paved roadway (such as the top surface 14 of the roadway 10 before being resurfaced) by cutting away a selected portion of the roadway, as discussed above. The planning assembly 68 in the preferred form comprises a planing cutter 138 that comprises a rotary drum 140 as shown in FIG. 5. The drum 140 is rotatably supported under the main frame 42 by way of the trunions 142 and 144 that are journally mounted in the support members 146 that extend downwardly from the main frame 42. The drum 140 is rotatable about its longitudinal axis 148 by a conventional hydraulic driving assembly (not shown) powered by the power drive unit 56.

Extending about the drum 140 is a spirally winding first flight 152 that begins near the end 154 and terminates near the center portion 156 of the drum 140. Another spirally winding second flight 158 begins near the end 160 and terminates near the center portion 156. The winding pitches of the flights 152 and 158 are opposite to each other and are designed so that the first flight 152 has apparent motion in the first end-to-center direction 162, and the second flight 158 has apparent motion in the second end to center direction 164 when the drum is rotated in the rotary direction 166 as viewed in FIG. 6. The planing cutter 138 is preferably rotated in the rotary direction 166 so as to cause the removed portion of the paved roadway 10 to be directed forwardly of the planing cutter 138 and generally moved from the ends 154, 160 in the apparent directions 162, 164 as the main frame 42 is driven in a forward direction 168.

Figure 7:
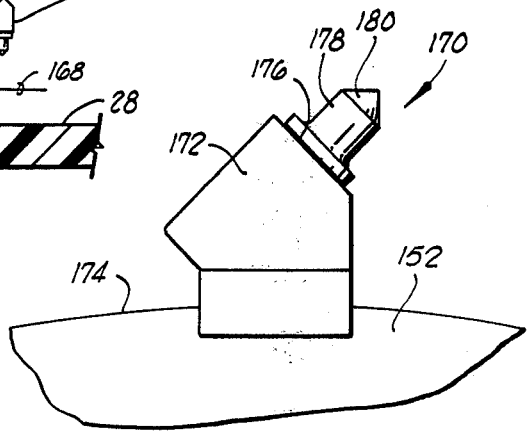
FIG. 7 is a view of one of the cutting heads used on the planing cutter shown in FIG. 5.

Attached along each of the flights 152 and 158 at approximately equal intervals are a plurality of cutting heads 170, a side view of one such cutting head being shown in FIG. 7. The cutting head 170 shown in FIG. 7 comprises a support block 172 which is attached to the outer edge 174 of the first flight 152. The support block 172 has an angled support surface 176 to which is attached a chisel cutter, the chisel cutter 178 having a cutting point 180 that is preferably made as an insert of tungsten carbide or the like.

In the preferred form, the planing cutter 138 is dimensioned such that the cutting points 180 of all of the cutting heads 170 are disposed equidistantly from the longitudinal axis 148 of the drum 140 so that the cutting points 180 form a uniform plante of cutting that is defind as being the location of the lowest point reached by the cutting points 180 as the planing cutter 138 is rotated. In other words, this cutting plane contains a line 182 that is defined as touching each of the cutting points 180 at their lowest point in the rotation of the planing cutter 138. The line 182 extends transversely to the paved roadway over which the planer apparatus 40 is driven for the reason that the planing cutter 138 is rigidly held by the main frame 42 across the roadway in transverse disposition thereto.

Figure 6:
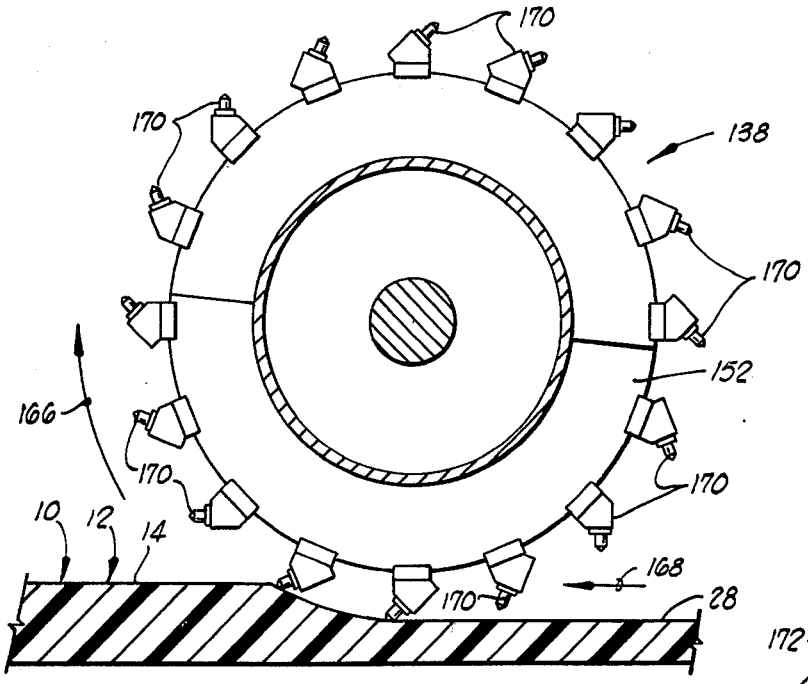
FIG. 6 is a view of the planar cutter taken at 613 6 in FIG. 5.

In FIG. 6, the planing cutter 138 is shown in cutting engagement with the top surface 14 of the paved roadway 10. (The numbered references relative to the roadway in FIG. 6 are used to relate to the depiction shown in FIG. 1.) As the planing cutter 138 is rotated in the rotary direction 166 and moved in the forward direction 168, the new roadway surface 28 is produced. This new roadway surface 28 will be very uniform if the cutting plane of the cutting heads 170 is uniform and coincident with the new roadway surface 28.

Referring to FIG. 5, it should be noted that a number of laterally extending paddle bars 184 are attached to the flights 152 and 158 at spaced intervals about the drum 140 near the center portion 156. The paddle bars 184 are recessed from the cutting heads 170 and serve in the fashion of scoops to throw the removed paving material cuttings upwardly to generally follow the drum 140 in the rotary direction 166. The purpose of this will become clear below.

Figure 8:
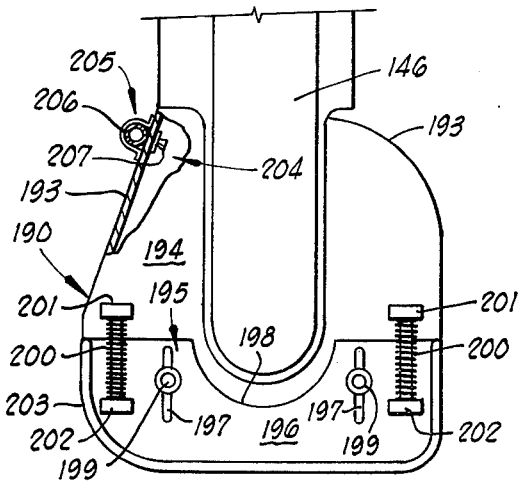
FIG. 8 is a side elevtional view showing the hood and one of the end shield members.

Continuing with a description of the planer assembly 68, it will be noted by reference to FIG. 2 that a hood 190, supported by conventional means on the main frame 42, is provided to partially surround the planing cutter 138 in the manner more clearly depicted by FIG. 8.

The hood 190 comprises an arcuately shaped member 193 that is supported by the main frame 42 via conventional bolting means to form a cover substantially forwardly, rearwardly and over the planing cutter 138, excepting the lower portion of the planing cutter 138 for exposure of the planing cutter 138 to cuttingly engage a paved roadway surface. An end panel 194 is attached to the member 193 at each end thereof for partially enclosing the planing cutter 138. Also, each end of the hood 190 is equipped with a sliding shield member 195, one of which is viewed in FIG. 8. The shield member 195 comprises a plate member 196 having a pair of slots 197 and an arbor clearing cutout 198. The shield member 195 is slidably supported on the end panel 194 via bolts 199 that extend through the slots 197. A pair of spring members 200 are compressingly supported between the lugs 201, extensive from the end panel 194, and the lugs 202, extensive from the plate member 196. An arcuately shaped runner member 203 is attached to the plate member 196 and serves as the pavement contacting edge of the shield member 195. As the planing assembly 68 is passed in cutting engagement with a pavement surface the shield members 195 are biased downwardly via the springs 200 to yieldingly close the lower ends of the hood 190 to retain the removed pavement material generally within the confines of the hood 190 for removal thereof via the floating moldboard 70 and the reclaimer assembly 80 as described more fully below.

In the manner described above, the hood 190 forms a material directing compartment 204 generally over the planing cutter 138. As the planning cutter 138 is rotated, the cutting heads 170 remove a selected top portion of the paved roadway 10, and the removed pavement material is directed upwardly into the material directing compartment 204. The lifting action imparted to the removed pavement material by the velocity of the cutting heads 170 is assisted by the movement of the flights 152 and 158 that tend to move the removed material from the ends 154, 160 of the drum 140 toward the center portion 156 thereof. Further, the paddle bars 184 rotating about the drum 140 tend to scoop and impart lifting action to the removed pavement material near the center portion 156. In order to minimize the effects of airborne dust and debris, a spray assembly 205 is provided that comprises a supply header 206 that is supported on the hood 190. A plurality of spray nozzles 207 are connected at intervals along the header 206 and are extensive through appropriately located ports into the material directing compartment 204. A supply tank and pump (not shown) are supported by the main frame 42, and a liquid such as water is carried in the supply tank. As this liquid is pumped to the supply header 206, a vapor mist is formed by the spray nozzles 207 in the material directing compartment 204. The effect of the vapor mist is to coalesce the airborne dust and debris, and serves to keep the mass of removed pavement material together as a body. The net result of this spraying is that the cutting action of the planer assembly 68 is practically dustless.

Figure 9:
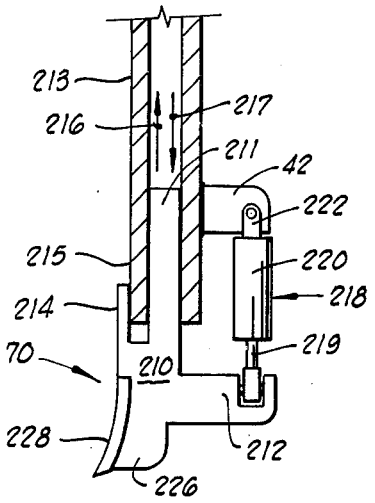
FIG. 9 is a side elevational view in partial cutaway depiction of the floating moldboard of the planer apparatus shown in FIG. 2.

The floating moldboard 70 is disposed just rearwardly to the planing cutter 138, and a semi-detailed view of the moldboard 70 is shown in FIG. 9. The moldboard 70 is a longitudinal member that is approximately the same length as the drum 140, and comprises a body portion 210 that has a pair of generally upwardly protruding guide members 211 and a pair of rearwardly extending members 212, one of each of the guide members 211 and the extending members 212 being disposed near the opposite ends of the floating moldboard 70. The side view shown in FIG. 9 shows one each of the guide members 211 and the extending membes 212. For each of the extending members 212 there is provided a hollow member 213 extensive downwardly from the underside of the main frame 42. The cross sectional shape of the extending member 212 is approximately rectangular and is dimensioned to be freely slidable in the hollow core of its respective member 213. A lip portion 214 extends upwardly from the body portion 210 along an outer surface 215 of the member 213 to assist in maintaining the free-sliding action of the floating moldboard 70 in the upward direction 216 and in the downward direction 217.

A pair of hydraulic cylinders 218 are provided, one each connected to each of the rearwardly extending members 212 as shown in FIG. 9. The hydraulic cylinder 218 shown therein has a retractable rod member 219 that is connected via conventional bolting means to the member 212, and a cylinder portion 220 that is bolted via the connector 222 to the main frame 42. The hydraulic cylinder 218 is connected to a conventional source of pressurized fluid via conduits (not shown) and the rod member 219 is yieldingly forced in the downward direction 217.

The moldboard 70 further comprises a heel portion 226 that is pressed by the biasing action of the hydraulic cylinders 218 into sliding contact with the new roadway surface 28 formed by the cutting action of the planing assembly 68. A molding panel 228 is attached to and forms the leading surface of the heel portion 226. The floating moldboard 70 is carried by the main frame 42 behind the planing assembly 68, and together with the reclaimer assembly 80 described above, serves to clear the roadway of the removed pavement material.

Figure 10:
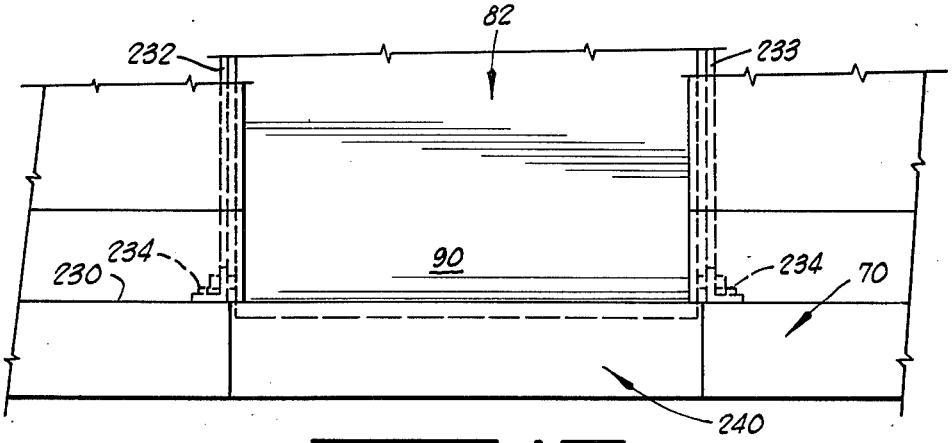
FIG. 10 is a partial plan view showing the attachment of the base elevator to the floating moldboard in the planer apparatus of FIG. 2.

As was mentioned above, it is desirable to have the material receiving end 90 of the base conveyor 82 in close proximity to the floating moldboard 70. This is achieved as shown in FIG. 10 by pivotally and supportingly connecting the material receiving end 90 of the base conveyor 82 to the back side 230 of the floating moldboard 70. This may be achieved by attaching the side frame members 232 and 233 of the base conveyor 82 viak conventional bolting means 234. The base conveyor 82 is also supported via pivoting hangers (not shown) to the main frame 42, permitting the material receiving end 90 to follow the upward and downward movement of the floating moldboard 70.

A passageway 240 is disposed in the body portion 210 of the floating moldboard 70 to facilitate the passage of removed pavement material from the material directing compartment 204 to the base conveyor 82. Appropriately shaped directing shields (not shown) may be provided to assist the flow of the removed pavementk material onto the base conveyor 82, and the use of conventional flexible sealing flaps (not shown) is suggested to prevent spillage of the removed pavement material onto the new pavement surface 28 in back of the floating moldboard 70.

The operation of the planer apparatus 40 will now be evident from the above discussion, but a summation will now be given. As stated, the present invention affords an improved method and apparatus for maintaining existing paved roads. Of course, it is contemplated that the planer apparatus 40 may find application in new road construction in some areas where it is desirable to plane a very hard substrate, as for example a naturally occurring rock substrate. However, the principle application of the planer apparatus 40 is believed to be found as a vast improvement for the road maintenance programs throughout this country and abroad. For the first time, existing paved roadways can be maintained in like new condition for a longer period of time by the invention advanced herein.

In the case of an existing paved roadway in need of repair, the roadway would first be examined to determine the amount of top surface that would need be removed to provide an acceptable new roadway surface. For example, if its appeared that the removal of two inches of the top portion of an existing bituminous paved roadway would undercut all or substantially all of the low portions in the road, the repair specifications would call for planing the roadway to a depth of two inches below the high points on the surface, or expressed as grade, to a predetermined grade to yield a two inch cut. Of course, the value of two inches is given by way of example only, and in no way it is meant to limit the present invention to a removal of that value. The specification could also require that the cross slope of the new surface be established at a predetermined value, as for example, the same as the cross slope of the earth substrate underlaying the pavement.

Once required elevation and the cross slope were established, an external reference line would be established. In some cases, an existing lane or curb might be selected, and a ski-line of conventional design might be selected. In other cases, a reference string-line might be selected and a string-line of known design would be installed alongside the paved roadway.

The setup of the planar apparatus 40 will be known and understood to persons having ordinary skill in the art of road construction equipment, and such details of operation will not be necessary herein. It will be sufficient to state that the planer apparatus 40 is placed over the roadway so as to transverse the pavement and alongside of the established string-line or the like. The planing apparatus 40 would then be driven down the paved roadway alongside the string-line in the manner described above utilizing the steering control 134 in conjunction with the track steering sensor 100 engaging the string-line.

The elevation of the main frame 42 would be maintained as described above utilizing the elevation control 122 in conjunction with the elevation sensor 102 engaging the string-line. Also, the cross slope of the main frame 42 would be maintained by the appropriate operation of the cross slope sensor and control apparatus 130 in the mmaner described above the set the cross slope of the main frame 42 at a predetermined value. Since the planer assembly 68 is rigidly secured under the main frame 42, the planing cutter 138 will be established to cut along a cutting plane extending transversely to the paved roadway 10 as the plural cutting heads 170 cut along the line 182 that extends transversely to the paved roadway 10.

As the plane of cutting is established va the means described above for establishing the grade and cross slope of the main frame 42 at predetermined values thereof, the result will be a uniform cutting action of the top surface of the roadway, exposing a uniform new roadway surface 28 as depicted in FIG. 1. The rotation of the planingcutter 138 is preferably in the rotating direction 166 as shown in FIG. 6 for the reason that cutting up against the grain of the paved roadway causes faults (undetected cracks and weak portions) to show up for the reason that the cutting is performed on the upstroke of the cutting heads 170. While the planing cutter 138 could be established to rotate in a counter direction to the rotary direction 166, the cutting action as illustrated in FIG. 6 reduces the impact force on the pavement since the cutters cut through and clear of the removed material, while in reverse cutting the cutters enter the concrete and continue through the pavement under the weight of the planing cutter. The apparstus 40 has been operated with the planing cutter 139 turned around and rotated counter to the rotary direction 166, and it was determined that greater power was necessary to advance the planer apparatus 40 over the roadway. A characteristic of some prior art planer apparatus has been to have an uneven driving movement forward, to the point that the forward motion could be described as being jerky. It has been noted that the drive of the present apparatus is very smooth, and this is believed to be a combination of the driving means employed along with the action of the planer assembly 68 that efficienttly removes the planed top surface and removes the cuttings from interfering with the further cutting action of the planer assembly 68 as it progresses along the paved roadway.

Another benefit of rotating the planing cutter 138 in the rotating direction 166 is that a pile of the removed pavement material is continuously caused to form in the forward path of the travel of the planing cutter 138 along the roadway. This removed pavement material is dampened by the vapor mist that is sprayed by the spray assembly 205, and the removed pavement material that continuously piles immediately in front of the planing cutter 138 serves to contain the dust created by the cutting action of the cutting heads 170, and to partially muffle the sound of the cutting. And although the removed pavement material is continuously removed via the lifting action described above, there is usually sufficient piling of the removed pavement material to give this beneficial dust containing and sound muffling function.

As the top portion of the roadway is removed in the manner described above, it has been determined that the removed portion of a bituminous roadway will be removed in relatively small pieces which are readily moved toward the center portion 156 of the drum 140 by the action of the flights 152 and 158, and that the rotating action of the paddle bars 184 will generally lift the cuttings of the removed pavement material up and over the planing cutter 138 to be received through the passageway 240 onto the material receiving end 90 of the base conveyor 82, and of course removed in a manner described above for the reclaiming assembly 80. The floating moldboard 70 serves to push any remaining cuttings in front thereof to the point that these overflow the moldboard via the passageway 240 or are slung around in front of the planing cutter 138 by the action of the flights 152 and 158. In practice, the combined action of the planing cutter 138 and the floating moldboard 70 has provided a very satisfactory clearing of the new pavement surface 28 and the placement of the cuttings of the new portion onto the reclaimer assembly 80 thereby.

Figure 11:
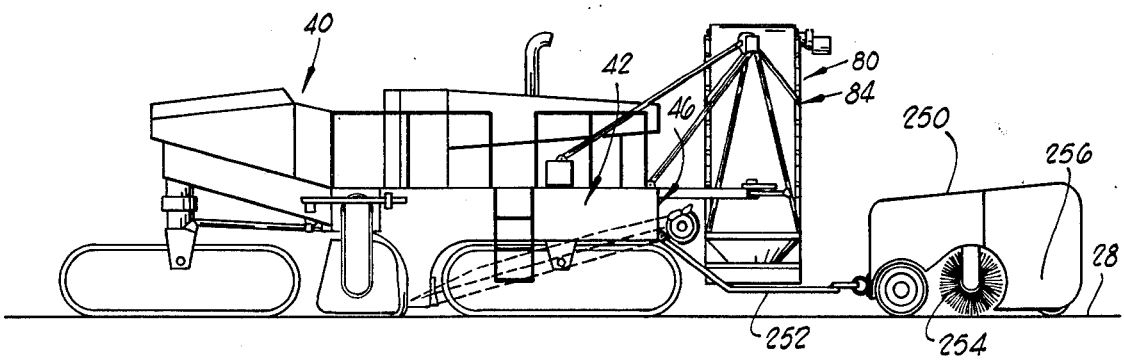
FIG. 11 is a side elevational view of a planer apparatus of the type shown in FIG. 2 and having a sweeper assembly attached thereto.

In most applications of the planer apparatus 40, the newly created surface will be sufficiently cleared of the cuttings of the removed roadway material in the manner described above. However, it is contemplated that there will be some applications in which it is desirable to sweep the new roadway surface following the path of the planer apparatus 40 to remove fine dust and debris not collected by the planer apparatus 40. This can be achieved by a following sweeper apparatus of the type shown in FIG. 11, wherein a sweeper assembly 250 is pulled behind the planer apparatus 40 via an extension bar 252 connected to the rearward end 46 of the main frame 42. The sweeper assembly 250 is conventional in design, and there are a large number of such sweepers available commercially, each having a sweeper 254 and a depository 256 cooperatively sweeping and retaining the dust and debris left on the new pavement surface 28 following the passage of the planer apparatus 40. Of course, a sweeper assembly performing the function of the sweeper assembly 250 could be mounted under the main frame 42, but the preferred embodiment is that as shown in FIG. 1 wherein the sweeper assembly 250 may be disengaged when not required.

It is clear from the description and discussion provided above that the planer apparatus 40 and the method of road maintenance afforded thereby meet each of the objects stated above. Further, it will be recognized that changes may be made in the construction and the arrangement of the various parts or elements of the apparatus, or of the steps of the method of the invention herein, without departing from the spirit and scope of the invention as defined in the following claims.

What is claimed is:

1. A planer apparatus for removing the top portion of an existing paved roadway to a predetermined grade established by a grade control reference, comprising in combination:

a main frame having a forward end, a rearward end, a left side and a right side;

a planer means for cutting the paved roadway along a cutting plane extending transversely to the paved roadway;

means supporting the planar means on the main frame to maintain the cutting plane parallel with the main frame;

drive means connected to the main frame for supporting and driving the main frame along the roadway;

elevation positioning means connected to the main frame and to the drive means for raising and for lowering the main frame relative to the drive means in an actuated position thereof;

elevation control means supported by the main frame and engaging the grade control reference for actuating the elevation positioning means and maintaining the elevation of the cutting plane at the predetermined grade;

cross slope positioning means connected to the main frame and to the drive means for raising and lowering one of the side of the main frame relative to the other side of the main frame in an actuated position thereof, whereby the cross slope of the cutting plane of the planer means is selectively determined;

cross slope control means supported by the main frame for actuating the cross slope positioning means to maintain a selected cross slope as the main frame is driven along the roadway; and reclaimer means carried by the main frame rearwardly of the planer means to receive the roadway material removed by the planer means, said reclaimer means including a moldboard floatinly carried by and relative to the main frame and biasing means yieldingly urging the moldboard against the roadway.

2. The planar apparatus of claim 1 wherein the drive means is characterized as comprising:

rear track means connected to the main frame, generally near the rearward end thereof, for drivingly moving the main frame;

front track means connected to the main frame, generally near the forward end thereof, for steering the planar apparatus during the operation thereof; and steering means connected to the front track means and to the main frame for steeringly moving the front track means.

3. The planar apparatus of claim 2 wherein the planer means supported by the main frame is characterized as comprising:

a rotatable planing cutter supported by the main frame and having a plurality of cutting heads forming the cutter plane; and power means for rotating the planing cutter.

4. The planer apparatus of claim 3 wherein the planing cutter is characterized as comprising:

a drum supported by the main frame transversely to the paved roadway and rotatable about an axis of rotation by the power means; and a flight attached to the drum and spirally winding thereabout, the flight having a pitch whereby the removed top portion of the roadway contacted thereby is moved toward the center portion of the drum.

5. The planer apparatus of claim 1 wherein the planar means is further characterized as comprising:

a hood supported by the main frame and partially surrounding the planing cutter to form a material directing compartment generally over the planing cutter into which the removed pavement material of the roadway is directed.

6. The planar apparatus of claim 5 wherein the planing cutter is rotated in a rotary direction that causes the removed portion of the roadway to be directed forwardly of the planing cutter as the main frame is moved by the drive means along the roadway.

7. The planar apparatus of claim 6 wherein the planer means is further characterized as comprising:

spray means supported by the main frame for sprayinga vapor mist in the material directing compartment.

8. The planar apparatus of claim 1 wherein the reclaimer means is further characterized as including:

an endless belt conveyor having a material receiving end supported by the moldboard and a material delivery end rearwardly thereof.

9. The planer type road construction apparatus of claim 1 further comprising:

sweeper means connected to the rearward end of the main frame assembly for sweepingly engaging the roadway and removing any removed roadway material not cleared by the cooperative action of the moldboard and the reclaimer means.

10. A planar apparatus for removing the top portion of an existing paved roadway, comprising:

planer means for cutting the paved roadway along a cutting plane extending transversely to the paved roadway, the planer means comprising:

a rotatable planing cutter supported by the main frame and having a plurality of cutting heads forming the cutter plane, the planing cutter being rotatable in a rotary direction that causes the removed portion of the roadway to be directed forwardly of the planing cutter as the main frame is moved by the drive means along the roadway, the planing cutter being characterized as comprising:

a drum supported by the main frame transversely to the paved roadway and rotatable about an axis of rotation by the power means; and a flight attached to the drum and spirally winding thereabout, the flight having a pitch whereby the removed top portion of the roadway contacted thereby is moved toward the center portion of the drum;

power means supported by the main frame for rotating the planing cutter;

a hood supported by the main frame and partially surrounding the planing cutter to form a material directing compartment generally over the planing cutter into which the removed pavement material of the roadway is directed; and spray means supported by the main frame for spraying a vapor mist in the material directing compartment;

means connected to the planar means for supporting and moving the planer means along the paved roadway with the cutting plane being maintained t a predetermined grade and cross slope, said means comprising:

a main frame having a forward end, a rearward end, a left side and a right side, the planar means supported by the main frame;

drive means connected to the main frame for supporting and dring the main frame along the roadway, the drive means comprising:

rear track means connected to the main frame, generally near the rearward end thereof, for drivingly moving the main frame;

front track means connected to the main frame, generally near the forward end thereof, for steering the planer apparatus during the operation thereof; and steering means connected to the front track means and to the main frame for steeringly moving the front track means;

elevation positioning means connected to the main frame and to the drive means for raising and for lowering the main frame relative to the drive means in an actuated position thereof;

elevation control means supported by the main frame for actuating the elevation positioning means in response to a control signal;

cross slope positioning means connected to the main frame and to the drive means for raising and lowering one of the sides of the main frame relative to the other side of the main frame in an actuated position thereof, whereby the cross slope of the cutting plane of the planer means is selectively determined; and cross slope control means supported by the main frame for actuating the cross slope positioning means to maintain a selected cross slope as the main frame is driven along the roadway;

a floating moldboard supported by the main frame and disposed rearwardly of the planar means;

biasing means supported by the main frame for biasing the moldboard into contact with the roadway;

reclaimer means supported by the main frame in near spatial relationship to the moldboard and cooperating with the moldboard for removing the removed top portion of the roadway;

a first side shield slidingly supported by the hood at one end thereof;

biasing means supported by the main frame for yieldingly forcing the first side shield into sliding engagement with the roadway as the main frame is driven therealong;

a second side shield slidingly supported by the hood at the other end thereof; and biasing means supported by the main frame for yieldingly forcing the second side shield in sliding engagement with the roadway as the main frame is driven therealong.

11. The planar apparatus of claim 10 further comprising:

sweeper means connected to the rearward end of the main frame for sweepingly engaging the roadway and removing any removed roadway material not cleared by the cooperative action of the moldboard and the reclaimer means.

12. A planer type road construction apparatus for removing a top portion of an existing paved roadway, comprising:

a main frame having a forward end, a rearward end, a left side, and a right side;

drive means connected to the main frame for supporting and driving the main frame along the roadway;

planer means supported by the main frame for cuttingly engaging the roadway to remove the top portion thereof and to produce a new roadway surface, the planer means characterized as comprising:

a hood supported by the main frame and partially surrounding the planing cutter to form a material directing compartment generally over the pavement material of the roadway is directed; and spray means supported by the main frame for spraying a vapor mist in the material directing compartment;

elevation positioning means connected to the main frame and to the drive means for raising and for lowering the main frame relative to the drive means in an actuated position thereof;

elevation control means supported by the main frame for actuating and controlling the elevation positioning means in response to a control reference whereby the new roadway surface is effected at a predetermined grade;

cross slope positioning means connected to the main frame and to the drive means for raising and lowering one side of the main frame relative to the other side of the main frame in an actuated position thereof, whereby the cross slope of the main frame is selectively determined;

cross slope control means supported by the main frame for actuating and controlling the cross slope positioningmeans to maintain a selected cross slope and the new roadway surface is effected at a predetermined cross slope;

a first side shield slidingly supported by the hood at one end thereof;

biasing means supported by the main frame for yieldingly forcing the first side shield in sliding engagement with the roadway as the main frame is driven therealong;

a second side shield slidingly supported by the hood at the other end thereof; and biasing means supported by the main frame for yieldingly forcing the second side shield in sliding engagement with the roadway as the main frame is driven therealong.

* * * * *

CERTIFICATE OF CORRECTION

Patent No. 4,139,318 Dated February 13, 1979

Inventor(s) Herbert E. Jakob and Richard A. Silbernagel

It is certified that error appears in the above-identified patent and that said Letters Patent are hereby corrected as shown below:

Column 1, line 26, "to" should be --top--.

Column 2, line 48, "tht" should be --that--.

Column 2, line 61, "613 6" should be -- 6-6 --.

Column 2, line 64, "elevtional" should be --elevational--

Column 2, line 66, there should be a new paragraph starting with FIG. 9.

Column 3, line 17, "thus" should be --that--.

Column 3, line 60, "paving" should be --paved--.

Column 4, line 14, "6" should be --16--.

Column 8, line 25, "equipement" should be --equipment--.

Column 8, line 29, "manula" should be --manual--.

Column 8, line 42, --be-- should be inserted between "can" and "controlled".

Column 9, line 22, "plante" should be --plane--.

Column 9, line 22, "defind" should be --defined--.

Column 10, line 28, --pavement-- should be inserted between "removed" and "material".

Column 10, line 61, "membes" should be --members--.

CERTIFICATE OF CORRECTION

Patent No. 4,139,318 Dated February 13, 1979

Inventor(s) Herbert E. Jakob and Richard A. Silbernagel

It is certified that error appears in the above-identified patent and that said Letters Patent are hereby corrected as shown below:

Column 11, line 34, "viak" should be --via--.

Column 11, line 44, "pavementk" should be --pavement--.

Column 12, line 1, "its" should be --it--.

Column 12, line 22, "planar" should be --planer--.

Column 12, line 40, "mmaner" should be --manner--.

Column 12, line 40, "the" should be --to--.

Column 12, line 48, "va" should be --via--.

Column 12, line 54, there should be a space between "planing" and "cutter".

Column 12, line 66, "apparstus" should be --apparatus--.

Column 12, line 67, "139" should be --138--.

Column 13, line 9 and 10, "efficienttly" should be --efficiently--.

Column 14, line 5, "1" should be --11--.

Column 14, line 43, "side" should be --sides--.

Column 14, line 54, "floatinly" should be --floatingly--.

Column 14, line 64, "planar" should be --planer--.

UNITED STATES PATENT OFFICE

CERTIFICATE OF CORRECTION

Patent No. 4,139,318 Dated February 13, 1979

Inventor(s) Herbert E. Jakob and Richard A. Silbernagel

It is certified that error appears in the above-identified patent and that said Letters Patent are hereby corrected as shown below:

Column 15, line 18, "planar" should be --planer--.

Column 15, line 26, "planar" should be --planer--.

Column 15, line 31, "planar" should be --planer--.

Column 15, line 36, "planar" should be --planer--.

Column 15, line 48, "planar" should be --planer--.

Column 16, line 11, "planar" should be --planer--.

Column 16, line 13, "t" should be --at--.

Column 16, line 21, "dring" should be --driving--.

Column 16, line 52, "planar" should be --planer--.

Column 17, line 3, "planar" should be --planer--.

Column 18, line 16, there should be a space between "positioning" and "means".

Signed and Sealed this

*First* Day of *May 1979*

[SEAL]

*Attest:*

RUTH C. MASON
*Attesting Officer*

DONALD W. BANNER
*Commissioner of Patents and Trademarks*